US006071042A

United States Patent [19]

Tichelar

[11] Patent Number: 6,071,042

[45] Date of Patent: Jun. 6, 2000

[54] ARTIFICIAL WAVE SURGE APPARATUS AND METHOD

[76] Inventor: Craig Tichelar, 3337 W. 109$^{th}$ St., Chicago, Ill. 60655

[21] Appl. No.: 09/056,724

[22] Filed: Apr. 7, 1998

[51] Int. Cl.$^{7}$ ..... E02B 3/00; A47K 3/10

[52] U.S. Cl. ..... 405/79; 4/491

[58] Field of Search ..... 405/79, 80, 52; 4/491

[56] References Cited

U.S. PATENT DOCUMENTS

| | | | |
|---|---|---|---|
| 3,477,233 | 11/1969 | Andersen | 405/79 |
| 4,276,664 | 7/1981 | Baker | 4/491 |
| 4,558,474 | 12/1985 | Bastenhof | 4/491 |
| 4,577,353 | 3/1986 | Viegener | 4/544 |
| 4,806,048 | 2/1989 | Ito | 405/79 |
| 4,823,413 | 4/1989 | Chalberg et al. | 4/544 |
| 5,079,784 | 1/1992 | Rist et al. | 4/542 |
| 5,095,941 | 3/1992 | Betz | 137/552 |
| 5,285,536 | 2/1994 | Long | 4/491 |
| 5,322,283 | 6/1994 | Ritchie et al. | 273/177 |
| 5,387,159 | 2/1995 | Hilgert et al. | 472/128 |
| 5,453,054 | 9/1995 | Langford | 472/117 |
| 5,519,299 | 5/1996 | Ferri et al. | 318/640 |
| 5,616,083 | 4/1997 | Subbaraman et al. | 472/67 |

*Primary Examiner*—Eileen Dunn Lillis
*Assistant Examiner*—Gary S. Hartmann
*Attorney, Agent, or Firm*—Hill & Simpson

[57] ABSTRACT

An artificial wave generating device employs an axially mounted vessel that is divided into two substantially equal chambers. The chambers are each separated by a planar member which extends from end to end and side to side of the cylindrical vessel. The dividing plate is adjusted to be at an angle such that gravity automatically rotates the device when the upper chamber is completely filled with water and a brake mechanism is released.

8 Claims, 3 Drawing Sheets

ARTIFICIAL WAVE SURGE APPARATUS AND METHOD

BACKGROUND OF THE INVENTION

1. Field of the Invention

The present invention relates generally to the field of special effect amusement devices. More specifically, the present invention is directed to a method and apparatus for generating an artificial wave crash or wave surge effect for amusement purpose.

2. Description of the Related Art

Artificial wave generating devices are generally known in the art, however, these known devices have numerous drawbacks. For example, known artificial wave generating or surge effect devices are inefficient in terms of the amount of energy required to provide the artificial wave or surge. Known devices typically expend energy in both physically moving water for the special effect and additionally these known devices require substantial amounts of energy in moving and resetting the machinery which is used in generating the artificial wave. Known wave generating devices typically include substantial mechanical elements which are very cumbersome. Specifically, in one such known device, one or more large mechanical panels are physically moved within a body of water. The repetitive oscillatory motion of the panel or panels generates the waves.

This system, like other know systems, consumes a significant amount of energy and though the system is good at generating wave action in a closed body of water, this system is not capable of generating a wave crash or surge effect which is comparable to a large wave crashing on a rocky shore.

Accordingly, it is a first object of the present invention to provide an artificial wave crash or surge device which is capable of providing a sudden and dramatic surge and crash of water that is comparable to the effect which is seen when a large wave crashes against a rocky shore.

It is another object of the present invention to provide an artificial wave crash or surge device which is energy efficient. It is yet another object of the present invention to provide an artificial wave surge or wave crash device which has a design which is not very complicated. Other objects and advantages of the present invention will be apparent from the following summary and detailed description of the preferred embodiments.

SUMMARY OF THE INVENTION

The present invention is directed to an artificial wave crash or surge effect device which is capable of providing a dramatic wave crash effect but which is also very energy efficient in its operation.

Advantageously, in the device of the present invention, a large vessel is divided into at least two distinct chambers. While one of the chambers is in a fill position, another chamber is in a position to discharge water from the chamber to provide the wave surge or crash effect.

Desirably, the vessel is located above the intended location of the wave crash to allow gravity to move the water and provide the crash or surge. In a preferred embodiment, the large vessel is a cylindrical member which is rotatably mounted to move freely around a central axis. The cylinder is divided by a planar member which extends both from side to side and from end to end in order to define substantially equal halves or chambers. Each of the chambers has a large opening in the side wall of the cylinder to allow water into the chamber during filling and also to allow the water to exit from the chamber when the cylinder is rotated into another position.

The cylinder is rotatably mounted so that side walls of the cylinder rotate from top to bottom. In a first position, one of the chambers is located on top and the other is on the bottom. The chamber which is located on top has the opening in the side wall at a highest position and is located to receive water from a large pipe so that the top chamber may be filled. The bottom chamber has the openings so that water contained in this chamber easily drops out of the chamber. The cylinder may be rotated to allow the chambers to switch positions.

The wall separating the two chambers forms a plane which is not perpendicular to a line drawn through the centers of the opposed side wall openings of the first and second chambers. Rather this wall which separates the two chambers is biased to be approximately 10 to 15 degrees from perpendicular so that the top chamber when filled will have a lower center of gravity on one side thus allowing gravity to rotate the cylinder when the chamber is filled with water.

A braking mechanism is employed to prevent the cylinder from rotating before the chamber is completely full. Additionally, a pneumatic system adjusts the cylinder to the most advantageous fill position.

The cylinder is located above the location of the wave crash and a funnel and channel member direct the flow of water to provide the desired effect.

It will be recognized by those skilled in the art that the device of the present invention may be controlled by either a microprocessor or by a pneumatic control system as described below with respect to the preferred embodiment.

DETAILED DESCRIPTION OF THE PREFERRED EMBODIMENTS

Figure 1:
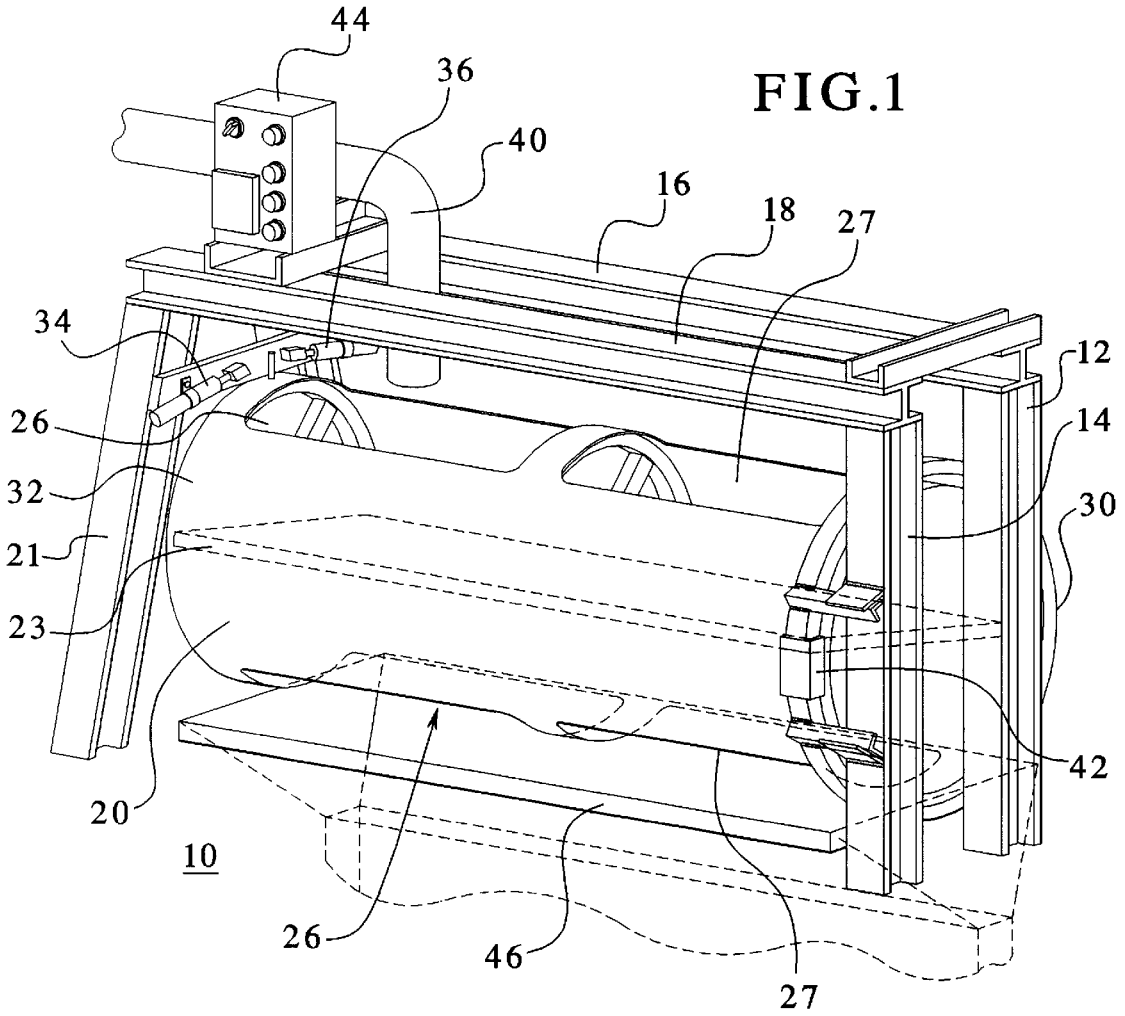
FIG. 1 illustrates a first embodiment of the vessel and filling mechanism of the present invention.

FIG. 1 illustrates a first embodiment of the present invention in which the mechanism for delivering the artificial wave surge or crash is shown generally at 10. The device includes a mounting structure which is comprised of steel beam members 12, 14, 16, 18, 21. The steel beams 12, 14 and 21 are secured to the floor and support the water carrying vessel 20. The water carrying vessel 20 is illustrated in the preferred embodiment as a cylinder, however, it will be recognized that the cylindrical shape is not critical but only preferred.

A dividing member 23 separates the hollow cylinder 20 into first and second halves or chambers. As can be seen from the illustration, each of the chambers has two holes 26, 27 in the respective side wall of the cylinder for filling and discharging water.

The cylinder 20 is rotatably mounted on first and second bearing filled ring mounts 30, 32 in order to reduce friction. Registration arms 34, 36 are pneumatically driven and ensure that the cylinder 20 is located appropriately in order to fill the cylinder 20 with water from filling pipe 40. Filling pipe 40 is located directly above hole 26 of each half of the cylinder when the device is rotated to the appropriate location by the registration arms 34, 36. The registration arms 34, 36 are simply piston driven members that extend simultaneously and meet at a central location in order to ensure that the device is rotated to the desired position. A brake member is used to lock the cylinder 20 into a fill position while the water is filling the chamber. Additionally, tie brake mechanism 42 is used to delay discharge of the water until the appropriate time. The brake member 42 locks the cylinder into its existing position and prevents further rotation of the device.

Control panel 44 allows adjustment of various operating parameters such as the amount of water which is placed into the chambers during filling. A trough 46 is the first portion of the mechanism for guiding the path of the water to focus the water for the wave surge. The remaining portions of this device are described below.

Figure 2:
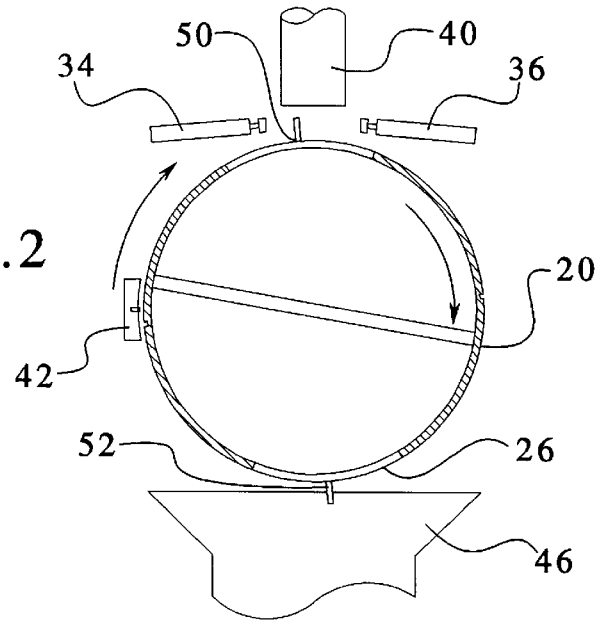
FIG. 2 illustrates the vessel and mechanism for adjusting the location chambers prior to filling.

FIG. 2 illustrates operation of the pneumatically driven registration arms 34, 36. During operation of this wave generating device, when gravity causes rotation of the vessel 20, there is typically either some over-rotation or under-rotation when the device rotates from a fill location for a chamber to a discharge location. In particular, the openings 26 in the side wall of the vessel 20 are not located in an ideal perpendicular relationship with respect to the surface of the supporting floor. Although the device will work to some degree, in order to ensure the most desirable operation of the device, after rotation of the vessel from a fill location to a discharge location, registration arms extend and engage the alignment pin, either 50 or 52, whichever is currently located in the upper location. One of the alignment pins 50, 52 is associated with the respective side chamber of vessel 20. As the registration arms 34, 36 extend from their respective rest positions, they engage the current upper alignment, pin 50 or 52. In the illustrated embodiment of FIG. 2, the alignment pin 50 engages registration arm 34 first. However, it will be recognized that depending on the rotation of the vessel, either arm 34 or 36 may be the first to engage the alignment pin.

Figure 3:
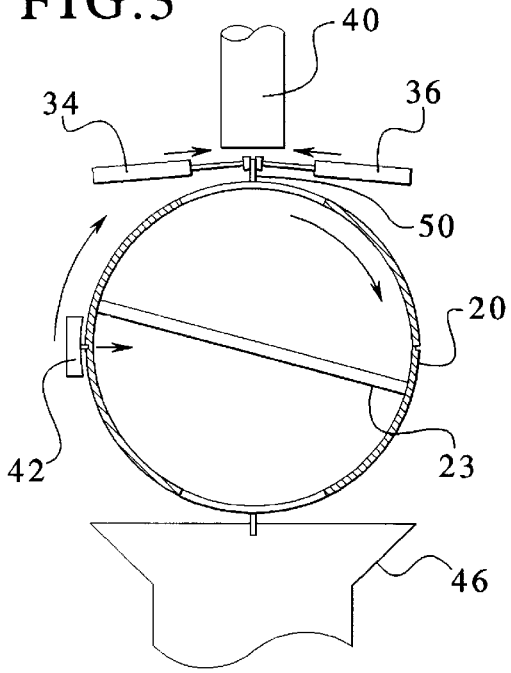
FIG. 3 illustrates the position of the chambers prior to filling.

FIG. 3 illustrates the relationship of the vessel 20 after the registration arms; 34, 36 have fully extended to force the alignment pin 50 into the top location. As can be seen from the drawing, the registration arms 34, 36, do not actually move, but rather pneumatic pistons drive extending rods which protrude from the respective registration arms and engage the appropriate alignment pin.

Once the vessel is driven to the desired location by the operation of the registration arms 34, 36, the brake member 42 engages the vessel 20 to prevent rotation of the vessel during filling of the vessel. The brake may be embodied as a protruding pin which engages a corresponding hole in a metal plate associated with the vessel 20, however, it will be recognized that any alternate braking mechanism may be used in order to prevent the vessel from rotating. Specifically, in the preferred embodiment, the brake mechanism is a pneumatically driven friction brake. FIG. 3 also illustrates the relationship of the dividing member 23 which divides the vessel 20 into substantially equal halves. The dividing member 23 is arranged so that when the vessel is locked in its fill position for either chamber of the vessel 20, the right hand side of the dividing member 23 is designed to be approximately 10–15 degrees off from a parallel relationship. This relationship allows the vessel to rotate about its central axis after the top chamber has been filled from pipe 40 upon release of the brake 42. This relationship is readily achieved for both sides of the vessel by having the dividing member pass through a central axis of the vessel 20.

Figure 4:
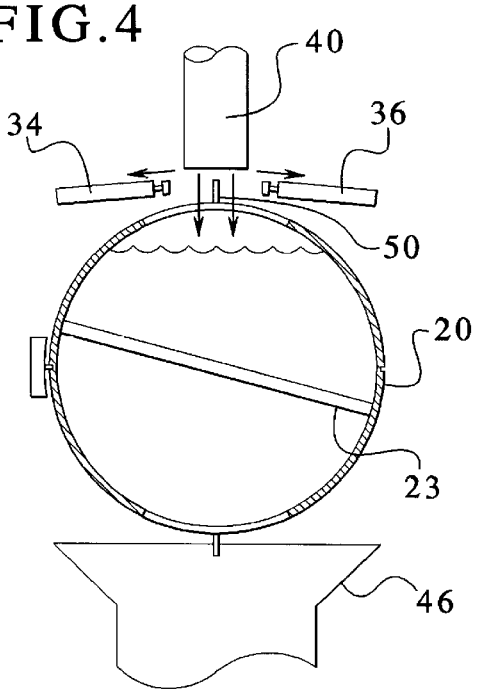
FIG. 4 illustrates the device after one of the chambers has been filled.

FIG. 4 illustrates filling of the top chamber after alignment by interaction between registration arms 34, 36 and alignment pin 50. After the brake 42 is engaged, the extending rods from the registration arms 34, 36 retract so that only the brake 42 maintains the position of the vessel 20. While the brake 42 is in its locked position, water fills the top chamber of the vessel 20 from pipe 40 through opening 26 in the side wall of the vessel 20.

Figure 5:
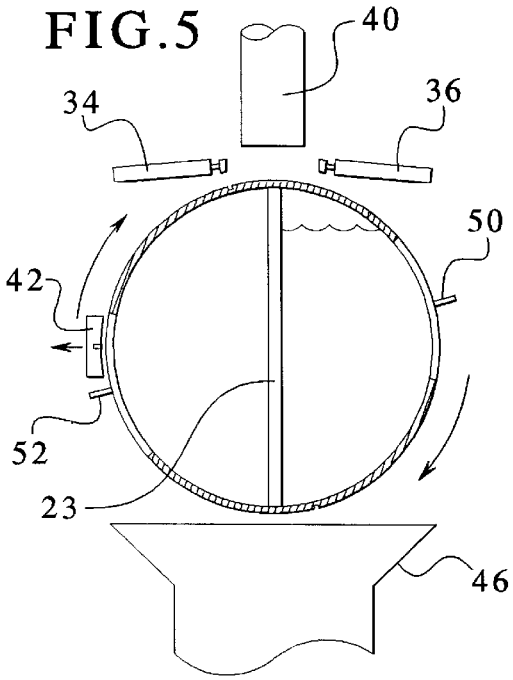
FIG. 5 illustrates the device while the chambers are rotating.

FIG. 5 illustrates rotation of the vessel 20 after release of the brake 42. Rotation of the vessel 20 occurs immediately upon release of the brake 42 without expending any additional energy. Gravity simply causes rotation upon release of the brake 42.

Figure 6:
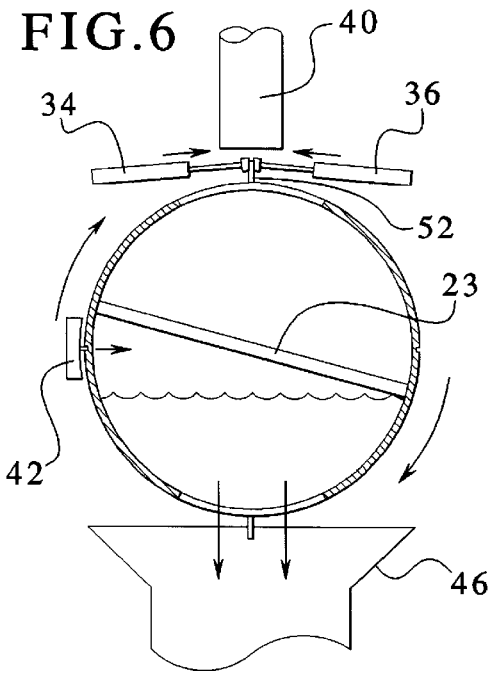
FIG. 6 illustrates the chambers after rotation during discharge of the water.

FIG. 6 illustrates discharge of the water from orifice 26 into funnel member 46. It will be recognized that although the illustration of FIG. 6 indicates that registration arms 34, 36 have engaged the alignment pin 52, it is preferred that the registration arms 34, 36 do not operate to engage the upper alignment pin 50 or 52 until the lower chamber has substantially or completely discharged all of its water into funnel 46. This timing is preferred in order to decrease the overall energy required for operation of the system. Furthermore, brake 42 does not engage the vessel 20 until after registration of the vessel by operation of the registration arms 34, 36.

Figure 7:
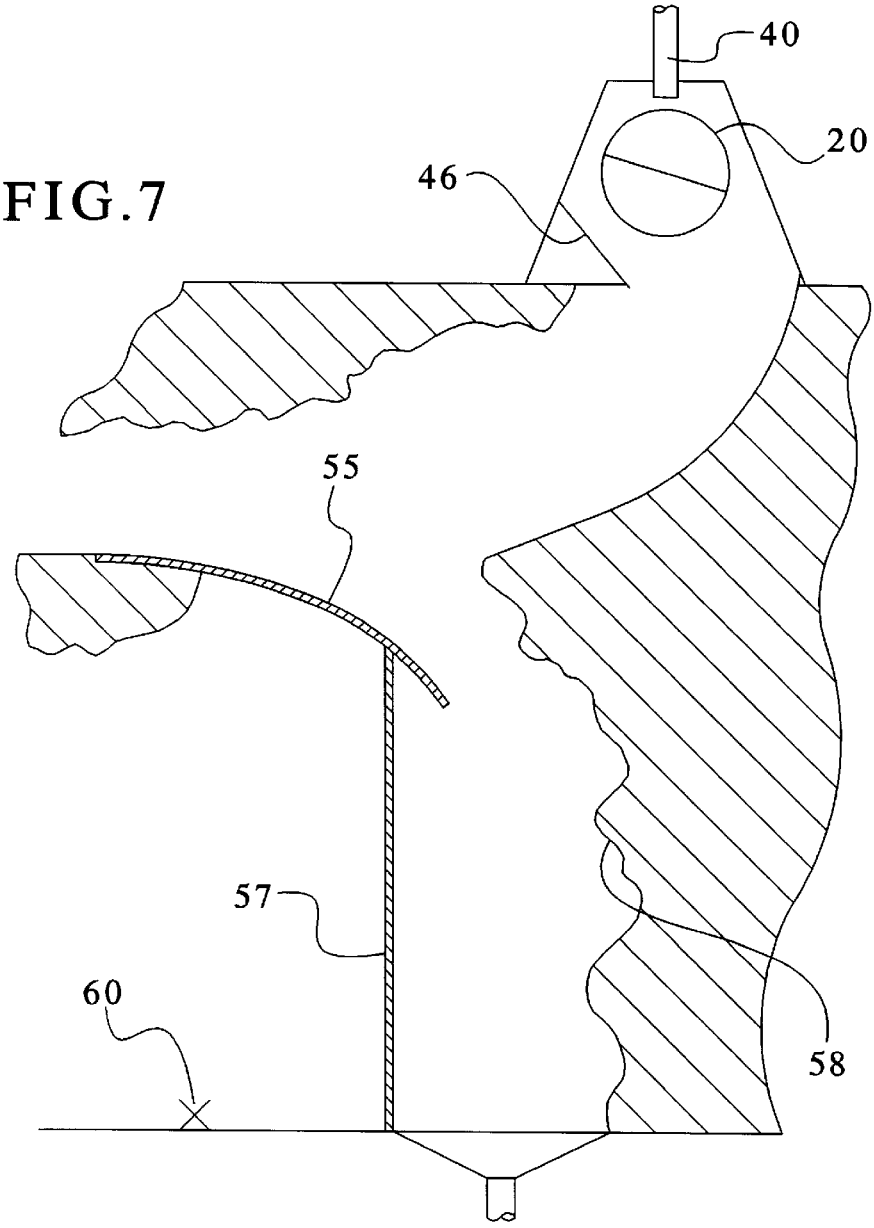
FIG. 7 illustrates an arrangement of the vessel and the location of wave crash effect.

FIG. 7 illustrates the flow of water from vessel 20 for the wave crash effect. The water discharges from opening 26 in the side wall of vessel 20 into funnel 46 which has an opening near its lowest point that directs the water onto transparent plexiglass top wall 55 which in turn directs the water onto artificial rock wall 58. Spray from the rock wall is thrown back toward observation point 60. Transparent plexiglass side wall 57 prevents water from splashing on people observing the special effect located at observation point 60.

The sudden flow of water from the orifice in the vessel 20 creates a very dramatic artificial wave crash or surge effect. It will be recognized that the specific design of the observation location of FIG. 7 is not critical to operation of the special effect device of the present invention. The dramatic wave effect caused by discharge of water from the vessel 20 may be directed and used in a wide variety of different ways.

Although it will be recognized that a microprocessor may be employed to control timing and controlling the operation of the wave crash device, in Applicant's preferred and actual embodiment, the device is controlled via a pneumatic control system. In the pneumatic control system, timing and control is accomplished through bleed valves and pneumatic switches. Additionally, as described below, an optical switch is used to trigger fill of the water into the chambers of the vessel.

Figure 8:
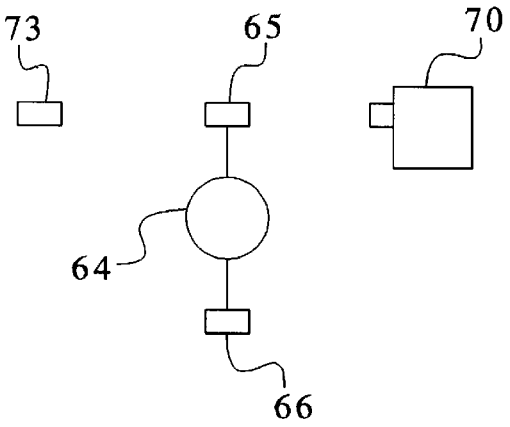
FIG. 8 illustrates operation of an optical switch which is used in controlling the device of the preferred embodiment.

FIG. 8 illustrates an optical switch which is used to trigger filling of the water chambers. The axle 64 on which the vessel 20 is mounted includes mechanical paddles 65 and 66 which are mounted on axle 64 at an end location for convenience. The paddles are used to block light emitted from the source 70 which is received by receiver 73 when either of the tabs 65 and 66 are at a location which indicates that the vessel has rotated such that the openings on opposite sides of the vessel are substantially vertically arranged. When either of the tabs 65 or 66 blocks the light, the optical switch is triggered to then open the water fill valve. When the valve is open it begins filling the upper chamber of vessel 20. A delay is included between triggering of the optical switch and opening of the water fill valve in order to allow the registration arms to perform their operation as described above. When registration of the vessel 20 is complete, after operation of registration arms 34 and 36, the brake is triggered through a pneumatic switch that is described below. The pneumatic switch sets a brake that is timed to allow the vessel to fill. While the vessel is filling, the brake is slowly bleeding off. When the vessel is completely full, brake has bled off sufficiently to allow the device to rotate. As the vessel rotates, its rotation accelerates until the top chamber is now located at the bottom and water rapidly leaves the vessel.

Figure 9:
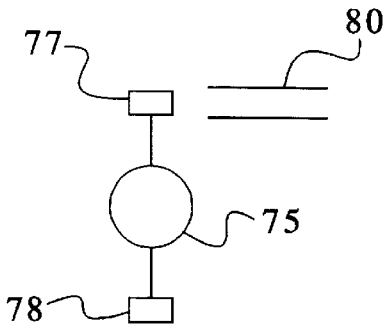
FIG. 9 illustrates operation of a pneumatic switch which is used in controlling the device of the preferred embodiment.

FIG. 9 illustrates the operation of the pneumatic switch mentioned with respect to the operation of the optical switch illustrated in FIG. 8. The pneumatic switch which is described above is similarly mounted on the axle 75 as illustrated in FIG. 9. This location, however, is at the opposite end to the location of the optical switch 70, 73 for convenience. The pneumatic switch includes tab members 77 and 78 that are aligned to block air transmitted through an air line 80. When the air line 80 is blocked by either tabs 77 or 78 the pneumatic switch is triggered and provides braking operation. This braking operation, due to the physical location of the tabs 77, 78, takes place only when vessel is oriented to the fill position, after discharge of the opposite chamber. There is a bleed valve which is not shown that allows the brake to bleed off while the water is filling so that once the water is completely filled, the brake is bled off sufficiently to allow the vessel to rotate placing the next mechanical paddle 66 or 65 in line of the optical sensing device to trigger another operation of the system. The system then completes and repeats the cycle until the device is shut down.

The present invention is subject to many variations, modifications and changes in detail. It is intended that all matter described throughout the specification and shown in the accompanying drawings be considered illustrative only. Accordingly, it is intended that the invention be limited only by the spirit and scope of the appended claims.

We claim as our invention:

1. An artificial water surge generating device comprising:

a rotatably mounted vessel having first and second chambers each of which have respective openings in a side wall of the vessel;

a fill pipe located above the vessel;

a discharge chute below the vessel; and an optical switch and a pneumatic switch being connected to said rotatably mounted vessel.

2. The artificial water surge device of claim 1, further comprising:

a fill mechanism for automatically filling an upper one of said chambers.

3. The artificial water surge device of claim 1, further comprising a braking mechanism for preventing rotation of the vessel while an upper one of said chambers is filling with water.

4. The artificial water surge device of claim 1, wherein the vessel is a cylindrical vessel.

5. The artificial water surge device of claim 1, further comprising a panel separating the first and second chambers, and the panel having a direction of rotation wherein the panel is biased slightly in the direction of rotation when the vessel is in a fill position for the first chamber.

6. The artificial water surge device of claim 1, further comprising said optical switch connected to an axle for initiating water filling into an upper one of said chambers.

7. The artificial water surge device of claim 1, further comprising said pneumatic switch connected to an axle for controlling said braking mechanism.

8. A method of generating an artificial water surge comprising the steps of:

providing a rotatably mounted vessel having first and second chambers;

applying a brake mechanism to prevent rotation of the vessel, said brake mechanism being controlled by a pneumatic switch;

filling an upper one of said chambers, said filling being initiated by an optical switch;

removing operation of the braking mechanism;

rotating the vessel; and discharging water from the chamber.

* * * * *